US012692610B2

(12) United States Patent
Shirataki et al.

(10) Patent No.: US 12,692,610 B2
(45) **Date of Patent: *Jul. 28, 2026**

(54) ELECTRODE CATALYST FOR WATER ELECTROLYSIS CELL, WATER ELECTROLYSIS CELLS, AND WATER ELECTROLYSIS DEVICES

(71) Applicant: Panasonic Intellectual Property Management Co., Ltd., Osaka (JP)

(72) Inventors: Hiroshi Shirataki, Tokyo (JP); Takao Hayashi, Osaka (JP); Hideaki Murase, Osaka (JP); Michio Suzuka, Kyoto (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 767 days.

This patent is subject to a terminal disclaimer.

(21) Appl. No.: 18/150,685

(22) Filed: Jan. 5, 2023

(65) Prior Publication Data

US 2023/0160082 A1 May 25, 2023

Related U.S. Application Data

(63) Continuation of application No. PCT/JP2021/022953, filed on Jun. 16, 2021.

(30) Foreign Application Priority Data

Jul. 17, 2020 (JP) ..... 2020-122911

(51) Int. Cl.
*C25B 11/054* (2021.01)
*C25B 1/04* (2021.01)
*C25B 11/057* (2021.01)
*C25B 11/077* (2021.01)

(52) U.S. Cl.
CPC ..... *C25B 11/054* (2021.01); *C25B 1/04* (2013.01); *C25B 11/057* (2021.01); *C25B 11/077* (2021.01)

(58) Field of Classification Search
CPC ..... C25B 1/04; C25B 11/054; C25B 1/01; C25B 11/057; C25B 11/077
See application file for complete search history.

(56) References Cited

U.S. PATENT DOCUMENTS

| | | | | |
|---|---|---|---|---|
| 2014/0255636 | A1 | 9/2014 | Odeh et al. | |
| 2016/0367948 | A1* | 12/2016 | Song | B01D 53/228 |
| 2018/0334751 | A1* | 11/2018 | Manabe | C25B 11/051 |
| 2019/0211151 | A1* | 7/2019 | Hefner, Jr. | C08G 73/0273 |
| 2021/0013536 | A1 | 1/2021 | Golden et al. | |

FOREIGN PATENT DOCUMENTS

| | | |
|---|---|---|
| JP | 2019-108596 A | 7/2019 |
| WO | 2005/012397 | 2/2005 |
| WO | 2017/091357 | 6/2017 |

OTHER PUBLICATIONS

English Translation of Chinese Search Report dated Mar. 1, 2025 for the related Chinese Patent Application No. 202180061479.8.

(Continued)

*Primary Examiner* — Ciel P Contreras
(74) *Attorney, Agent, or Firm* — Rimon P.C.

(57) ABSTRACT

An electrode catalyst for a water electrolysis cell includes a catalyst and a polymer of intrinsic microporosity, and the polymer of intrinsic microporosity is neutral.

10 Claims, 3 Drawing Sheets

(56) References Cited

OTHER PUBLICATIONS

The EPC Office Action dated Sep. 17, 2024 for the related European Patent Application No. 21841344.1.
Patil Bhushan et al: "Atomic Layer Deposition of NiOOH/Ni(OH) 2 on PIM-1-Based N-Doped Carbon Nanofibers for Electrochemical Water Splitting in Alkaline Medium", ChemSusChem, [Online] vol. 12, No. 7, Apr. 9, 2019 (Apr. 9, 2019), pp. 1469-1477, XP093193428.
Mahajan Ankita et al: "Polymer of Intrinsic Microporosity (PIM-7) Coating Affects Triphasic Palladium Electrocatalysis", ChemEelectroChem, [Online] vol. 6, No. 16, Nov. 7, 2018 (Nov. 7, 2018), pp. 4307-4317, XP093193410.
Ponomarev I I et al: "New Gas-Diffusion Electrode Based on Heterocyclic Microporous Polymer PIM-1 for High-Temperature Polymer Electrolyte Membrane Fuel Cell", Russian Journal of Electrochemistry, Maik Nauka/ Interperiodica Publishing, Moscow, RU, vol. 55, No. 6, Jul. 18, 2019 (Jul. 18, 2019), pp. 552-557, XP036839146.
He Daping et al: "Intrinsically microporous polymer slows down fuel cell catalyst corrosion", Electrochemistry Communications, vol. 59, Jul. 23, 2015 (Jul. 23, 2015), pp. 72-76, XP093193408.
Rong Yuanyang et al: "High-Utilisation Nanoplatinum Catalyst (Pt@cPIM) Obtained via Vacuum Carbonisation in a Molecularly Rigid Polymer of Intrinsic Microporosity", Electrocatalysis, Springer US, Boston, vol. 8, No. 2, Dec. 12, 2016 (Dec. 12, 2016), pp. 132-143, XP036165678.
He Daping et al: "Fuel cell anode catalyst performance can be stabilized with a molecularly rigid film of polymers of intrinsic microporosity (PIM)", RSC Advances, [Online] vol. 6, No. 11, Jan. 18, 2016 (Jan. 18, 2016), pp. 9315-9319, XP055925684.
Leong Shi Xuan et al: "One-step preparation of microporous Pd@cPIM composite catalyst film for triphasic electrocatalysis", Electrochemistry Communications, vol. 86, Nov. 8, 2017 (Nov. 8, 2017), pp. 17-20, XP093192511.
International Search Report of PCT application No. PCT/JP2021/022953 dated Aug. 17, 2021.
Canghai Ma et al., "Polymers of Intrinsic Microporosity (PIMs) Gas Separation Membranes: A mini Review", Proceedings of the Nature Research Society, 2018, vol. 2, No. 02002, Jan. 22, 2018, pp. 1-19.
Mariolino Carta et al., "The synthesis of microporous polymers using Troger's base formation", Polymer Chemistry, 2014, vol. 5, Jun. 20, 2014, pp. 5267-5272.
Xu Wu et al., "A polymethacrylate-based quaternary ammonium $OH^-$ ionomer binder for non-precious metal alkaline anion exchange membrane water electrolysers", Journal of Power Sources, 2012, vol. 214, May 4, 2012, pp. 124-129.
International Search Report of PCT Application PCT/JP2021/035119 dated Dec. 7, 2021.
Zhengjin Yang et al., "Highly Conductive Anion-Exchange Membranes from Microporous Troger's Base Polymers", Angewandte Chemie International Edition, 2016, vol. 55, Aug. 9, 2016, pp. 11499-11502.
Non-Final Office Action dated Sep. 9, 2025 issued in U.S. Appl. No. 18/183,210.

* cited by examiner

ELECTRODE CATALYST FOR WATER ELECTROLYSIS CELL, WATER ELECTROLYSIS CELLS, AND WATER ELECTROLYSIS DEVICES

BACKGROUND

1. Technical Field

The present disclosure relates to an electrode catalyst for a water electrolysis cell and also relates to water electrolysis cells and water electrolysis devices.

2. Description of the Related Art

In recent years, the development of a catalyst material that is used in a water electrolysis device has been expected.

International Publication No. 2017/091357 discloses a polymer having a Tröger's base skeleton. International Publication No. 2005/012397 discloses a polymer having a spirobiindane skeleton. U.S. Patent Application Publication No. 2014/255636 discloses a polymer membrane containing an imide group.

Canghai Ma et al., Polymers of Intrinsic Microporosity (PIMs) Gas Separation Membranes: A mini Review, Proceedings of the Nature Research Society, 2018, Vol. 2, No. 02002, pp. 1-19 (Non-Patent Literature 1) discloses a membrane containing Polymers of Intrinsic Microporosity (PIM), Mariolino Carta et al., The synthesis of microporous polymers using Troger's base formation, Polymer Chemistry, 2014, Vol. 5, pp. 5267-5272 (Non-Patent Literature 2) discloses a porous polymer having a Tröger's base.

SUMMARY

In one general aspect, the techniques disclosed here feature an electrode catalyst for a water electrolysis cell. The electrode catalyst includes a catalyst and a polymer of intrinsic microporosity, and the polymer of intrinsic microporosity is neutral.

Additional benefits and advantages of the disclosed embodiments will become apparent from the specification and drawings. The benefits and/or advantages may be individually obtained by the various embodiments and features of the specification and drawings, which need not all be provided in order to obtain one or more of such benefits and/or advantages.

DETAILED DESCRIPTION

Figure 1:
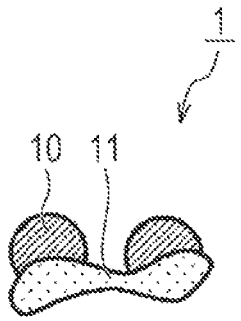
FIG. 1 is a schematic diagram of an electrode catalyst for a water electrolysis cell, according to a first embodiment.

Underlying Knowledge Forming Basis of the Present Disclosure

A step for combating global warming that is attracting attention is the utilization of renewable energy, such as solar power or wind power. However, power generation that uses renewable energy presents a problem in that the excess electrical power goes to waste. That is, the renewable energy is not necessarily utilized with sufficient efficiency. Correspondingly, studies are being conducted regarding methods for producing hydrogen from excess electrical power and storing the hydrogen.

A typical method for producing hydrogen from excess electrical power may be the electrolysis of water. The electrolysis of water is also referred to as water electrolysis. It is desired that a highly efficient and long-lasting water electrolysis device be developed so that hydrogen can be produced inexpensively and consistently. Principal constituent elements of a water electrolysis device include a membrane electrode assembly (MEA), which is formed of a gas diffusion layer, a catalyst, and an electrolyte membrane.

Providing a highly efficient and long-lasting water electrolysis device requires, in particular, improvements in the performance and durability of the catalyst. In an electrode catalyst for a water electrolysis cell, an organic material may be used to improve the dispersibility of the catalyst material and/or improve the binding strength thereof with respect to a substrate, such as an electrode. The use of an organic material improves the dispersibility of the catalyst material and the binding strength thereof with respect to a substrate.

However, organic materials typically have high electrical resistance, and, therefore, in instances where an organic material covers an active site of a surface of a catalyst, the overvoltage can increase when a voltage is applied. Accordingly, it is important to provide an electrode catalyst that can reduce loss due to the overvoltage of an electrode even in instances in which an organic material is used. In view of this, the present inventors diligently performed studies regarding materials that enable a reduction in the area of coverage on a catalyst. As a result, it was newly discovered that using a polymer of intrinsic microporosity (PIM) is advantageous in reducing the overvoltage of an electrode catalyst for a water electrolysis cell.

Based on the finding, the present inventors discovered a novel electrode catalyst for a water electrolysis cell. The electrode catalyst is described below.

Overview of Aspects of Present Disclosure

According to a first aspect of the present disclosure, an electrode catalyst for a water electrolysis cell includes:

- a catalyst; and
- a polymer of intrinsic microporosity, the polymer of intrinsic microporosity being neutral.

With regard to the first aspect, an electrode catalyst for a water electrolysis cell can be provided, with the electrode catalyst having a low overvoltage.

In a second aspect of the present disclosure, for example, in the electrode catalyst for a water electrolysis cell according to the first aspect, the polymer of intrinsic microporosity may have a Tröger's base skeleton.

In a third aspect of the present disclosure, for example, in the electrode catalyst for a water electrolysis cell according to the first aspect, the polymer of intrinsic microporosity may have a spirobiindane skeleton.

In a fourth aspect of the present disclosure, for example, in the electrode catalyst for a water electrolysis cell according to the first aspect, the polymer of intrinsic microporosity may have a polyimide skeleton.

With regard to the second to fourth aspects, the electrode catalyst for a water electrolysis cell can inhibit an increase in the overvoltage.

According to a fifth aspect of the present disclosure, a water electrolysis cell includes:

an anode;

a cathode; and an electrolyte membrane disposed between the anode and the cathode.

At least one selected from the group consisting of the anode and the cathode includes the electrode catalyst according to any one of the first to fourth aspects.

With regard to the fifth aspect, the water electrolysis cell can inhibit an increase in the overvoltage.

In a sixth aspect of the present disclosure, for example, in the water electrolysis cell according to the fifth aspect, the electrolyte membrane may include a proton exchange membrane.

In a seventh aspect of the present disclosure, for example, in the water electrolysis cell according to the fifth aspect, the electrolyte membrane may include an anion exchange membrane.

With regard to the sixth and seventh aspects, oxygen gas generated at the anode and hydrogen gas generated at the cathode do not easily mix with each other.

According to an eighth aspect of the present disclosure, a water electrolysis cell includes:

a diaphragm that separates a first space from a second space;

an anode provided in the first space; and a cathode provided in the second space.

At least one selected from the group consisting of the anode and the cathode includes the electrode catalyst according to any one of the first to fourth aspects.

With regard to the eighth aspect, the water electrolysis cell can inhibit an increase in the overvoltage.

According to a ninth aspect of the present disclosure, a water electrolysis device includes:

the water electrolysis cell according to any one of the fifth to eighth aspects; and a voltage applicator that applies a voltage between the anode and the cathode, the voltage applicator being connected to the anode and the cathode.

With regard to the ninth aspect, the water electrolysis device can inhibit an increase in the overvoltage.

Embodiments of the present disclosure will now be described with reference to the drawings. The present disclosure is not limited to the embodiments described below.

First Embodiment

FIG. 1 is a schematic diagram of an electrode catalyst for a water electrolysis cell, according to the present embodiment. An electrode catalyst 1, according to the present embodiment, includes a catalyst 10 and a polymer of intrinsic microporosity (PIM) 11, which is neutral. The PIM 11 is present on at least a portion of a surface of the catalyst 10. With this configuration, the area of the exposed surface of the catalyst 10 is unlikely to be reduced even in the presence of the PIM 11 on the surface of the catalyst 10, and, consequently, a reduction in the catalytic activity of the electrode catalyst 1 can be inhibited. As a result, in instances where a voltage is applied to the electrode catalyst 1, an increase in the overvoltage can be inhibited. That is, the electrode catalyst 1 can have a low overvoltage.

Polymer of Intrinsic Microporosity

The polymer of intrinsic microporosity (PIM) 11 is typically an organic polymer having a specific molecular structure and intrinsic microporosity.

As described above, the PIM 11 is neutral. The term "neutral" means that a molecule does not include any anion exchange group or cation exchange group. Examples of the anion exchange group include quaternary ammonium groups. Examples of the cation exchange group include sulfonic acid ionic groups.

The PIM 11 may be present on at least a portion of a surface of the catalyst 10. In addition, the PIM 11 may be present, for example, on a substrate on which the electrode catalyst 1 is formed. Specifically, the PIM 11 may be present on a surface of the substrate. The presence of the PIM 11 in the electrode catalyst 1 improves the binding strength between a substrate and the catalyst 10 in instances in which the electrode catalyst 1 is formed on the substrate. Consequently, the electrode catalyst 1 can have high durability.

The PIM 11 may have a function of dispersing the particles of the electrode catalyst 1. In this instance, the presence of the PIM 11 in the electrode catalyst 1 prevents aggregation of the particles of the electrode catalyst 1.

Examples of the molecular structure of the PIM 11 include a Tröger's base skeleton, a spirobiindane skeleton, and a polyimide skeleton.

For example, the Tröger's base skeleton includes a bicyclic compound, and the bicyclic compound contains two bridgehead nitrogen atoms. The nitrogen atoms form a chiral center. The Tröger's base skeleton may further include at least one of an ethanoanthracene skeleton and a triptycene skeleton. Specifically, the Tröger's base skeleton has a molecular structure represented by general formula (1) below.

(1)

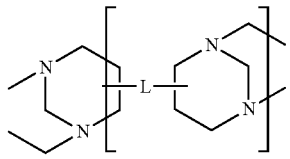

In general formula (1), L represents a linker. The linker L is not limited to any particular structure. Examples of the linker L include aromatic rings, spirobiindane skeletons, ethanoanthracene skeletons, and triptycene skeletons.

For example, the spirobiindane skeleton includes two indans. The two indans are connected to each other via a spiro atom center to form a spiro compound. The "spiro compound" is a bicyclic organic compound, in which one of the atoms that form a ring is shared by the other ring. The one of the atoms is referred to as a Spiro atom. In the present disclosure, for example, the indan includes a benzene ring connected to a 5-membered ring that contains a spiro atom or includes a benzene ring connected to a 6-membered ring that contains a spiro atom. Specifically, the spirobiindane skeleton has a molecular structure represented by general formula (2) or (3) below.

(2)

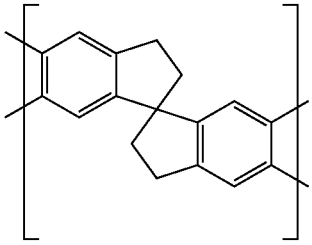

(3)

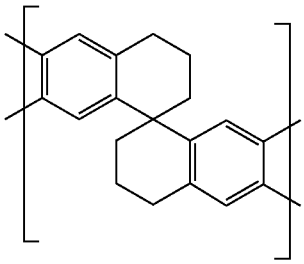

The polyimide skeleton is formed, for example, by polycondensation of an acid anhydride with a diamine. The polyimide skeleton may further include at least one of a spirobiindane skeleton, an ethanoanthracene skeleton, and a triptycene skeleton. For example, the polyimide skeleton has a molecular structure represented by general formula (4) below.

(4)

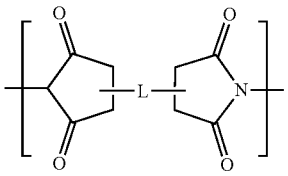

In general formula (4), L represents a linker. The linker L is not limited to any particular structure. Examples of the linker L include aromatic rings, spirobiindane skeletons, ethanoanthracene skeletons, and triptycene skeletons.

Examples of the PIM 11 include organic polymers having a Tröger's base skeleton, organic polymers having a spirobiindane skeleton, and organic polymers having a polyimide skeleton. A particular molecular structure of the PIM 11 may include at least one selected from the group consisting of Tröger's skeletons, spirobiindane skeletons, and polyimide skeletons. These skeletons may have intrinsic microporosity. In addition, these skeletons may be skeletons having high stiffness. The presence of any of these skeletons in the molecular structure enables the PIM 11 to have a desired porosity. The PIM 11 may have any of these skeletons in a main chain or a side chain thereof. It is sufficient that the PIM 11 have at least one of a Tröger's base skeleton, a spirobiindane skeleton, and a polyimide skeleton. The PIM 11 may further have an additional substituent group. Examples of the additional substituent group include halogen groups, hydroxy groups, alkyl groups, alkoxy groups, carboxy groups, ester groups, acyl groups, amino groups, nitro groups, sulfonic groups, and aryl groups. Examples of the halogen groups include fluoro groups, chloro groups, and bromo groups.

The PIM 11 may include at least one selected from the group consisting of organic polymers having a Tröger's base skeleton, organic polymers having a spirobiindane skeleton, and organic polymers having a polyimide skeleton.

The PIM 11 has an average pore diameter of less than or equal to 4 nm, for example. The average pore diameter of the PIM 11 can be measured by using a Brunauer-Emmett-Teller (BET) method, which is a $N_2$ gas adsorption method. The average pore diameter of the PIM 11 can be measured in the following manner, for example. By using a pore distribution analyzer VacPrep 061, available from Shimadzu Corporation-Micromeritics Instrument Corporation, a sample including the PIM 11 is degassed under reduced pressure at 100° C. for 15 hours. Subsequently, by using an automatic specific surface area analyzer TriStar II 3020, available from Shimadzu Corporation-Micromeritics Instrument Corporation, an analysis of a pore distribution is carried out by using the $N_2$ gas adsorption method. In this manner, the average pore diameter of the PIM 11 can be calculated.

Catalyst

The catalyst 10 is a material having activity for the reaction that generates gases, such as hydrogen and oxygen, at an anode or a cathode of a water electrolysis cell. Examples of the catalyst 10 include metals and metal compounds. Examples of the metals include Pt. Examples of the metal compounds include a layered double hydroxide (LDH) and $IrO_x$.

For example, the LDH includes two or more transition metals. The transition metals include at least two selected from the group consisting of V, Cr, Mn, Fe, Co, Ni, Cu, W, and Ru, for example.

The LDH has a composition represented, for example, by composition formula (1) below.

Composition formula (1)

$$[M_1^{2+}{}_{1-x}M_2^{3+}{}_x(OH)_2][yA^{n-}\text{—}mH_2O]$$

In composition formula (1), $M_1^{2+}$ is an ion of a divalent transition metal. $M_2^{3+}$ is an ion of a trivalent transition metal. $A^{n-}$ is an anion present between layers. x is a rational number satisfying the condition of $0<x<1$. y is a number corresponding to an amount necessary for a charge balance. n is an integer. m is an appropriate rational number.

The may contain Ni and Fe. In composition formula (1), $M_1$ may be Ni, and $M_2$ may be Fe. That is, the transition metal elements included in the LDH may be Ni and Fe. With this configuration, the electrode catalyst 1 can have higher catalytic activity.

In the LDH, the ratio of an amount of substance of the Fe to a total amount of substance of the Ni and Fe may be greater than or equal to 0.25 and less than or equal to 0.5. With this configuration, the electrode catalyst 1 can have higher catalytic activity.

The LDH may include a chelating agent. In this instance, the chelating agent may coordinate with the transition metal ion in the LDH. In this case, the LDH may have improved dispersion stability. Furthermore, the presence of the chelating agent in the LDH may enable the synthesized LDH to have a small particle diameter. As a result, the LDH can have an improved surface area, which in turn can improve catalytic activity. The LDH may have an average particle diameter of less than or equal to 100 nm or less than or equal to 50 nm. Furthermore, the average particle diameter of the LDH may be less than or equal to 10 nm. The average particle diameter of the LDH is a value determined as follows. A particle size distribution of the LDH, which is obtained by small angle X-ray scattering (SAXS), is represented in a two-dimensional distribution graph that shows a relationship between the particle diameter and the distribution, and the area in the two-dimensional distribution graph is divided by the total number of the particles. The distribution indicates numerical values proportional to the total volume of the particles of a corresponding particle diameter. The area in the two-dimensional distribution graph is, for example, the product of a particle diameter and the number of particles corresponding to the particle diameter.

The chelating agent is not limited to any particular chelating agent. For example, the chelating agent is an organic compound that coordinates with a transition metal in the LDH. The chelating agent may be at least one selected from bidentate organic ligands and tridentate organic ligands. Examples of the chelating agent include β-diketones, β-ketoesters, and hydroxycarboxylic acids. Examples of the β-diketones include acetylacetone (ACAC), trifluoroacetylacetone, hexafluoroacetylacetone, benzoylacetone, thenoyltrifluoroacetone, dipivaloylmethane, dibenzoylmethane, and ascorbic acid. Examples of the β-ketoesters include methyl acetoacetate, ethyl acetoacetate, allyl acetoacetate, benzyl acetoacetate, n-propyl acetoacetate, isopropyl acetoacetate, n-butyl acetoacetate, isobutyl acetoacetate, tert-butyl acetoacetate, 2-methoxyethyl acetoacetate, and methyl 3-oxopentanoate. Examples of the hydroxycarboxylic acids and salts thereof include tartaric acid, citric acid, malic acid, gluconic acid, ferulic acid, lactic acid, glucuronic acid, and salts thereof. The chelating agent may include at least one selected from the group consisting of acetyl acetone and trisodium citrate. The chelating agent may be at least one selected from acetylacetone and trisodium citrate.

$A^{n-}$ is an interlayer anion. $A^{n-}$ is an inorganic ion or an organic ion. Examples of the inorganic ion include $CO_3^{2-}$, $NO_3^-$, $Cl^-$, $SO_4^{2-}$, $Br^-$, $OH^-$, $F^-$, $I^-$, $Si_2O_5^{2-}$, $B_4O_5(OH)_4^{2-}$, and $PO_4^{3-}$. Examples of the organic ion include $CH_3(CH_2)_nSO^{4-}$, $CH_3(CH_2)_nCOO^-$, $CH_3(CH_2)_nPO^{4-}$, and $CH_3(CH_2)_nNO^{3-}$. $A^{n-}$ is an anion intercalated between the layers of the metal hydroxide together with water molecules. $A^{n-}$ has a charge and an ionic size, which are not limited to any particular value. The LDH may include one type of $A^{n-}$ or two or more types of $A^{n-}$.

Figure 2:
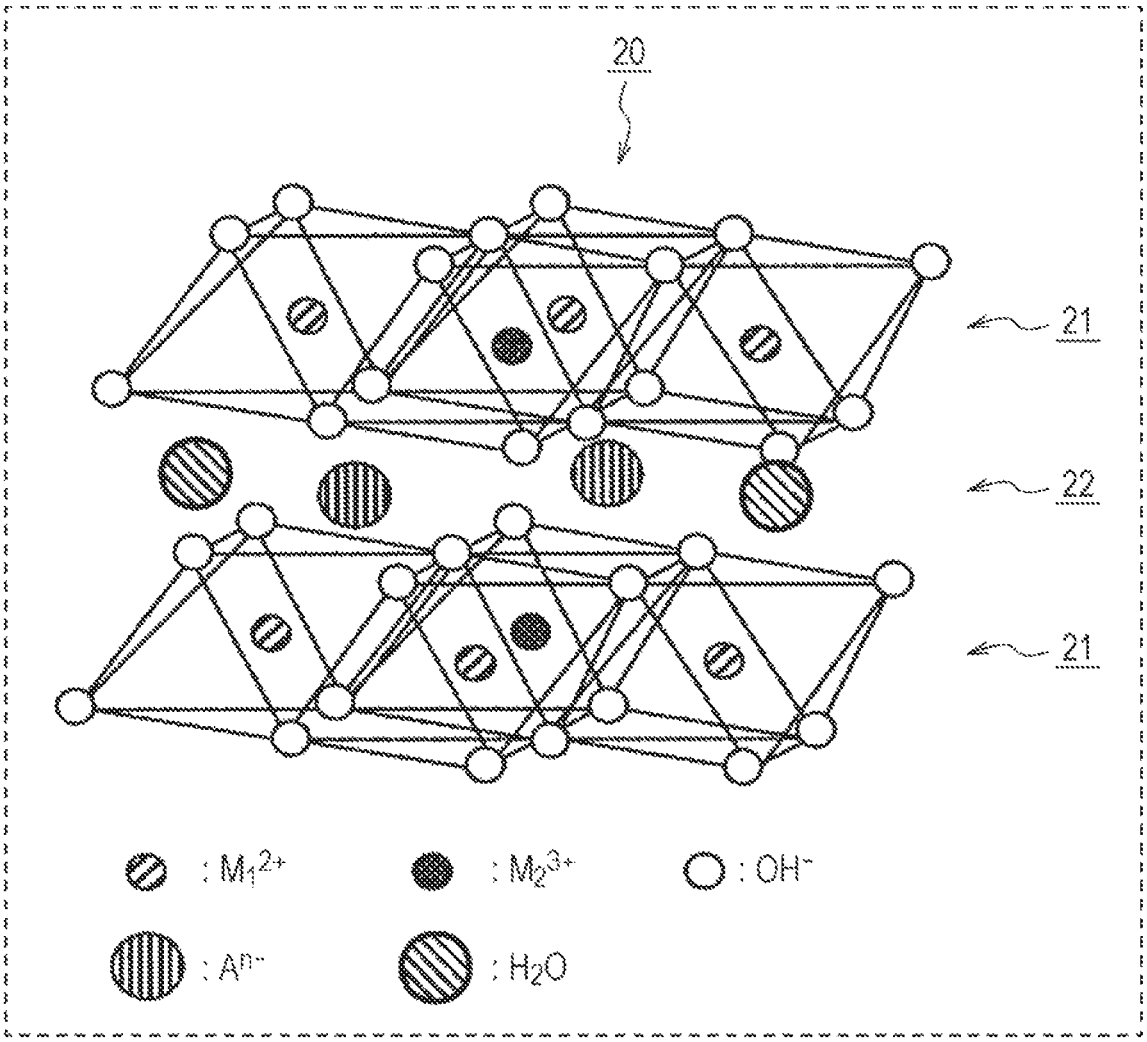
FIG. 2 is a schematic diagram of an exemplary crystal structure of a layered double hydroxide (LDH)

FIG. 2 is a schematic diagram of an exemplary crystal structure of the LDH represented by composition formula (1). As illustrated in FIG. 2, an LDH 20 includes an $OH^-$ ion on each of the vertices of octahedra, in which $M_1^{2+}$ or $M_2^{3+}$ is the center. The metal hydroxide is represented by $[M_1^{2+}{}_{1-x}M_2^{3+}{}_x(OH)_2]^{x+}$. The metal hydroxide has a layered structure in which hydroxide octahedra are two-dimensionally connected to one another with edges thereof being shared. The anion and water molecules are positioned between the layers of the metal hydroxide. The layers of the metal hydroxide serve as host layers 21, between which the anion and water molecules, which serve as guest layers 22, are intercalated. That is, the LDH 20, as a whole, has a sheet structure in which the host layers 21, which are formed of the metal hydroxide, and the guest layers 22, which are formed of the anion and water molecules, are alternately layered. The LDH 20 has a structure in which some of the $M_1^{2+}$ present in the layers of the metal hydroxide is replaced by the $M_2^{3+}$. Accordingly, a surface of the LDH 20 is typically positively charged.

Support

The electrode catalyst 1 may further include a support. With this configuration, the support for the catalyst 10 enables the catalyst 10 to be stably disposed, and as a result, the electrode catalyst 1 is likely to maintain a high catalytic activity.

Typically, the support has a conductivity. The support is not limited to any particular material. Examples of the support include transition metals and carbon materials. Examples of the transition metals include V, Cr, Mn, Fe, Co, Ni, Cu, W, and Ru. Examples of the carbon materials include acetylene black and Ketjen black (KB).

A shape of the support is not limited to any particular shape. The shape of the support may be a foam shape or a particle shape.

For example, the electrode catalyst 1 according to the present embodiment is used in a proton exchange membrane type water electrolysis device, an anion exchange membrane type water electrolysis device, or an alkali diaphragm type water electrolysis device. The electrode catalyst 1 may be used in at least one selected from an anode and a cathode in any of these water electrolysis devices.

Second Embodiment

Figure 3:
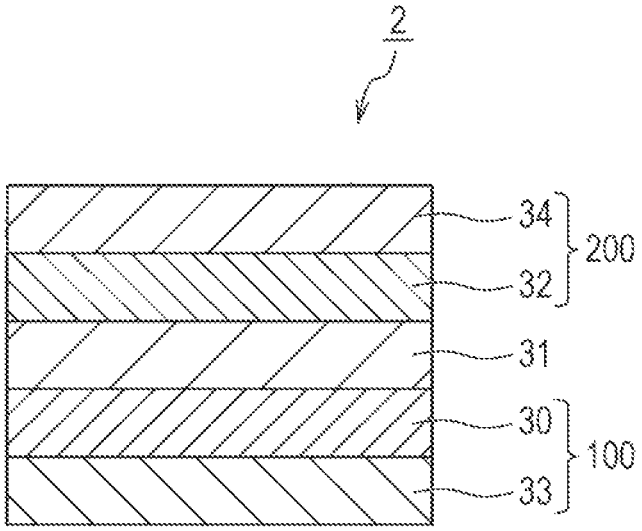
FIG. 3 is a schematic cross-sectional view of an exemplary water electrolysis cell, according to a second embodiment.

FIG. 3 is a schematic cross-sectional view of an exemplary water electrolysis cell, according to the present embodiment.

A water electrolysis cell 2 includes an electrolyte membrane 31, an anode 100, and a cathode 200. The electrolyte membrane 31 is disposed between the anode 100 and the cathode 200, for example. At least one selected from the anode 100 and the cathode 200 includes the electrode catalyst 1, which is described in the first embodiment.

The electrolyte membrane 31 may be an electrolyte membrane having ionic conductivity. The electrolyte membrane 31 is not limited to any particular type. The electrolyte membrane 31 may include a proton exchange membrane. The electrolyte membrane 31 may be a proton exchange membrane. The electrolyte membrane 31 may include an anion exchange membrane. The electrolyte membrane 31 may be an anion exchange membrane. The electrolyte membrane 31 is configured such that oxygen gas generated at the anode 100 and hydrogen gas generated at the cathode 200 do not easily mix with each other.

The anode 100 includes a catalyst layer 30, for example. The catalyst layer 30 may be provided on one of major surfaces of the electrolyte membrane 31. The "major surfaces" refers to surfaces having the largest area of the electrolyte membrane 31. The catalyst layer 30 includes an electrode catalyst, which may be the electrode catalyst 1 of the first embodiment. The anode 100 may further include a gas diffusion layer 33, which is porous and conductive and may be provided on the catalyst layer 30.

The cathode 200 includes a catalyst layer 32, for example. The catalyst layer 32 may be provided on the other of the major surfaces of the electrolyte membrane 31. That is, the catalyst layer 32 may be provided on the major surface of the electrolyte membrane 31 opposite to the major surface on which the catalyst layer 30 is provided. A catalyst metal that may be used in the catalyst layer 32 is not limited to any particular type. The electrode catalyst may be platinum or the electrode catalyst 1. The cathode 200 may further include a gas diffusion layer 34, which is porous and conductive and may be provided on the catalyst layer 32.

With any of the configurations described above, the water electrolysis cell 2 can inhibit an increase in the overvoltage;

this is because at least one selected from the anode 100 and the cathode 200 includes the electrode catalyst 1.

Third Embodiment

Figure 4:
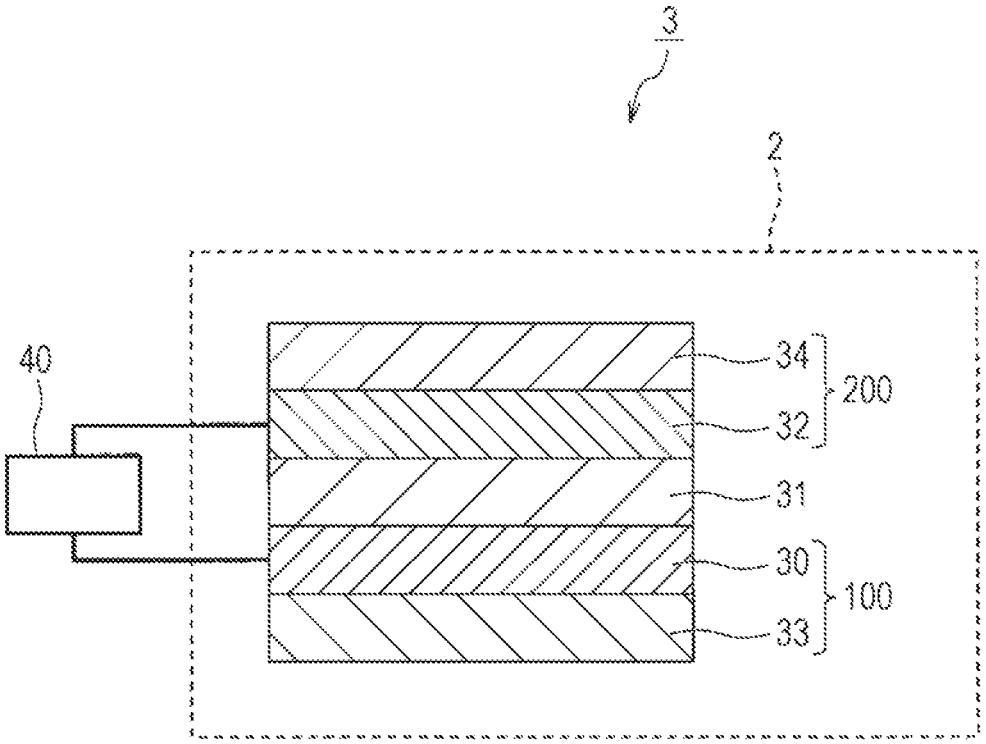
FIG. 4 is a schematic cross-sectional view of an exemplary water electrolysis device, according to a third embodiment.

FIG. 4 is a schematic cross-sectional view of an exemplary water electrolysis device, according to the present embodiment.

A water electrolysis device 3 includes a water electrolysis cell 2 and a voltage applicator 40. The water electrolysis cell 2 is similar to the water electrolysis cell 2 of the second embodiment, and, therefore, descriptions thereof will be omitted.

The voltage applicator 40 is connected to an anode 100 and a cathode 200 of the water electrolysis cell 2. The voltage applicator 40 is a device that applies a voltage between the anode 100 and the cathode 200 in the water electrolysis cell 2.

The voltage applicator 40 increases the potential of the anode 100 and decreases the potential of the cathode 200. The voltage applicator 40 is not limited to any particular type provided that the voltage applicator 40 can apply a voltage between the anode 100 and the cathode 200. The voltage applicator 40 may be a device that adjusts the voltage to be applied between the anode 100 and the cathode 200. Specifically, in instances where the voltage applicator 40 is connected to a DC power supply, such as a battery, a solar cell, or a fuel cell, the voltage applicator 40 includes a DC/DC converter. In instances where the voltage applicator 40 is connected to an AC power supply, such as a commercial power supply, the voltage applicator 40 includes an AC/DC converter. The voltage applicator 40 may be a power-type power supply that adjusts the voltage that is applied between the anode 100 and the cathode 200 and adjusts the current that flows between the anode 100 and the cathode 200, such that the power to be supplied to the water electrolysis device 3 is adjusted to a predetermined set value.

With any of the configurations described above, the water electrolysis device 3 can inhibit an increase in the overvoltage.

Fourth Embodiment

Figure 5:
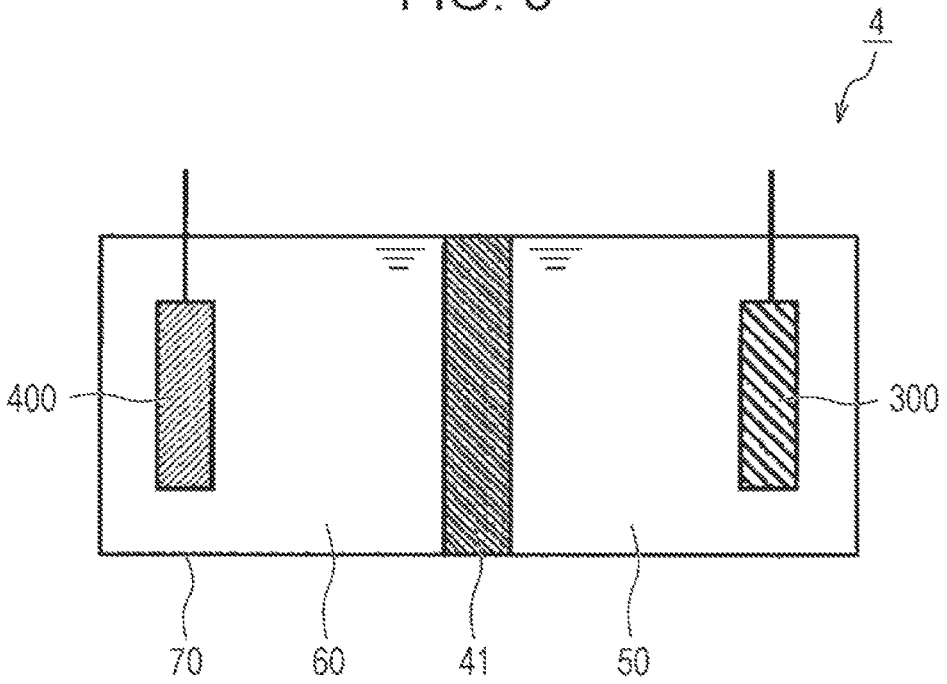
FIG. 5 is a schematic cross-sectional view of another exemplary water electrolysis cell, according to a fourth embodiment.

FIG. 5 is a schematic cross-sectional view of another exemplary water electrolysis cell, according to the present embodiment.

The water electrolysis cell according to the present embodiment is, for example, an alkaline water electrolysis cell 4, which utilizes an alkaline aqueous solution. In alkaline water electrolysis, an alkaline aqueous solution is used. Examples of the alkaline aqueous solution include aqueous potassium hydroxide solutions and aqueous sodium hydroxide solutions.

The alkaline water electrolysis cell 4 includes an anode 300 and a cathode 400. The alkaline water electrolysis cell 4 further includes an electrolysis chamber 70, a first space 50, and a second space 60. The anode 300 is provided in the first space 50. The cathode 400 is provided in the second space 60. The alkaline water electrolysis cell 4 includes a diaphragm 41. The diaphragm 41 is provided within the electrolysis chamber 70 and separates the first space 50 from the second space 60. At least one selected from the anode 300 and the cathode 400 includes the electrode catalyst 1.

The anode 300 may include the electrode catalyst 1. For example, the anode 300 may include a catalyst layer, and the electrode catalyst 1 may be included in the catalyst layer.

The cathode 400 may include the electrode catalyst 1, For example, the cathode 400 may include a catalyst layer, and the electrode catalyst 1 may be included in the catalyst layer.

The diaphragm 41 is a diaphragm for alkaline water electrolysis, for example.

The anode 300 may be disposed in contact with the diaphragm 41, or the anode 300 may be spaced apart from the diaphragm 41. The cathode 400 may be disposed in contact with the diaphragm 41, or the cathode 400 may be spaced apart from the diaphragm 41.

The alkaline water electrolysis cell 4 produces hydrogen and oxygen by electrolyzing an alkaline aqueous solution. An aqueous solution containing a hydroxide of an alkali metal or an alkaline earth metal may be supplied to the first space 50 of the alkaline water electrolysis cell 4. An alkaline aqueous solution may be supplied to the second space 60 of the alkaline water electrolysis cell 4. The production of hydrogen and oxygen is carried out by performing electrolysis while discharging an alkaline aqueous solution having a predetermined concentration from the first space 50 and the second space 60.

With any of the configurations described above, the alkaline water electrolysis cell 4 can inhibit an increase in the overvoltage; this is because at least one selected from the anode 300 and the cathode 400 includes the electrode catalyst 1.

Fifth Embodiment

Figure 6:
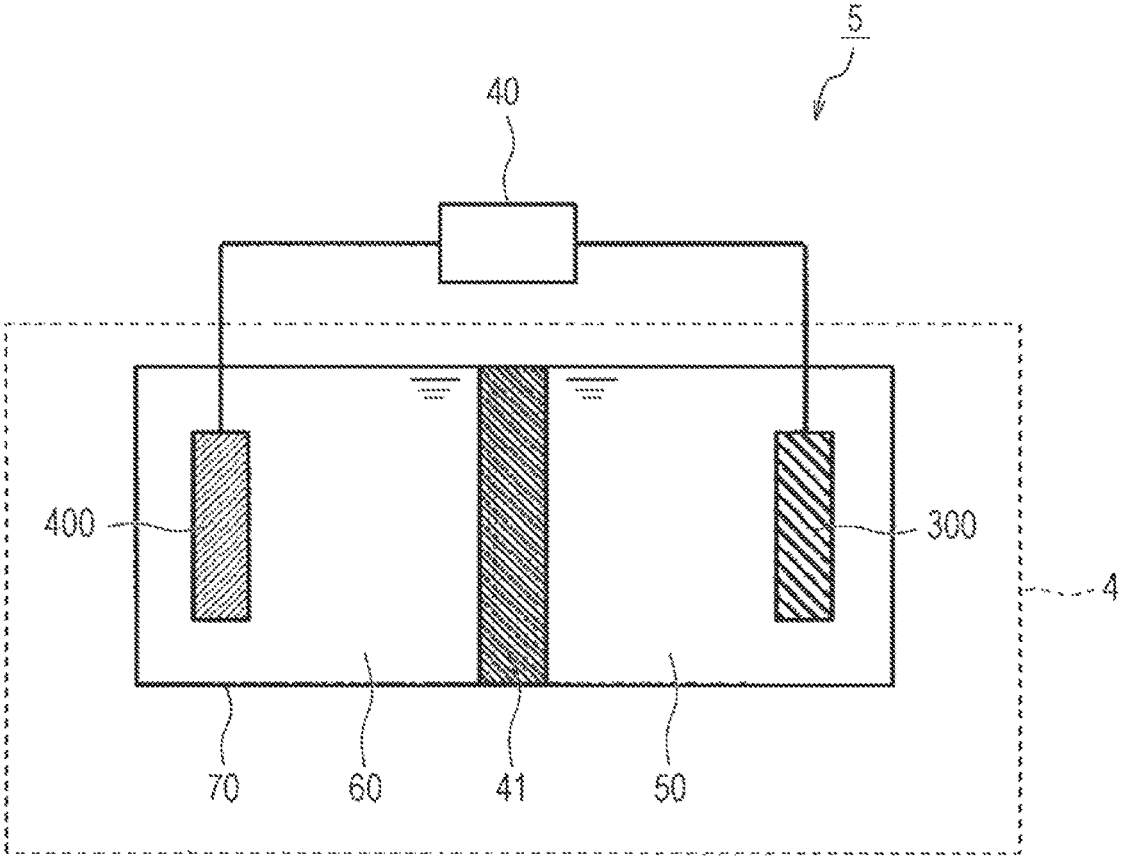
FIG. 6 is a schematic cross-sectional view of another exemplary water electrolysis device, according to a fifth embodiment.

FIG. 6 is a schematic cross-sectional view of another exemplary water electrolysis device, according to the present embodiment.

The water electrolysis device according to the present embodiment is, for example, an alkaline water electrolysis device 5, which utilizes an alkaline aqueous solution. The alkaline water electrolysis device 5 includes an alkaline water electrolysis cell 4 and a voltage applicator 40. The alkaline water electrolysis cell 4 is similar to the alkaline water electrolysis cell 4 of the fourth embodiment, and, therefore, descriptions thereof will be omitted.

The voltage applicator 40 is connected to an anode 300 and a cathode 400 of the alkaline water electrolysis cell 4. The voltage applicator 40 is a device that applies a voltage between the anode 300 and the cathode 400 in the alkaline water electrolysis cell 4.

With this configuration, the alkaline water electrolysis device 5 can inhibit an increase in the overvoltage.

EXAMPLES

The present disclosure will now be described in more detail with reference to examples. Note that the examples described below are merely illustrative of the present disclosure and are not to be construed as limiting the present disclosure.

Example 1

Preparation of Ni—Fe LDH Supported on Ni Support

A mixture including a Ni—Fe LDH and Ni particles was prepared in the following manner. First, a mixed solvent of water and ethanol (special grade reagent, manufactured by FUJIFILM Wako Pure Chemical Corporation) was prepared. A volume ratio between the water and the ethanol was 2:3. Nickel chloride hexahydrate (manufactured by FUJIFILM Wako Pure Chemical Corporation) and iron chloride hexahydrate (manufactured by FUJIFILM Wako Pure Chemical Corporation) were dissolved in the mixed solvent such that a total concentration of the Ni ions and Fe ions became 1.0 M, and the ratio of the amount of substance of the Fe ions to the total amount of substance of the Ni ions and the Fe ions became 0.33. Note that "M" denotes "mol/dm$^3$". Furthermore, acetylacetone (ACAC), which was used as a chelating agent, was added such that the amount of substance of the acetylacetone became one-third of the total amount of substance of the Ni ions and the Fe ions. The obtained solution was stirred for 30 minutes. Ni particles (manufactured by US Research Nanomaterials, Inc., a particle diameter of 40 nm) were added to the solution, with the mass of the Ni particles being equal to the mass of a Ni—Fe LDH that would be produced if all the Ni and Fe present in the solution ideally reacted. Next, propylene oxide (POX), which was used as a pH raising agent, was added to the solution containing the Ni—Fe LDH and the Ni particles such that the amount of substance of the POX became twice the amount of substance of the chloride ions present in the solution. The obtained solution was stirred for 1 minute. In such an instance, POX gradually scavenges hydrogen ions in the solution, and, therefore, the pH of the solution gradually increases. Accordingly, the obtained solution was allowed to stand for approximately three days, and subsequently, the mixture of the Ni—Fe LDH and the Ni particles, which was the target sample, was collected.

Preparation of PIM (1)

PIM (1), which is a PM of Example 1, was prepared as described in Non-Patent Literature 2. 1 molar equivalent of 4,4'-diamino-3,3'-dimethylbiphenyl was dissolved in 5 molar equivalents of dimethoxymethane. The solution was cooled to 0° C. Next, 120 molar equivalents of trifluoroacetic acid was added dropwise to the solution over a period of 0.5 hours. The resulting mixed solution was stirred at room temperature for 5 days. Next, the resulting mixed solution was added to an aqueous solution of ammonium hydroxide, which was being vigorously stirred, and the resultant was allowed to stand for 2 hours. The resulting solids were collected by filtration and washed with water, methanol, and acetone, in this order.

After washing, the solids were dissolved in chloroform, and methanol was added to precipitate the polymer. This operation was repeated twice. The resulting polymer was dried in a vacuum oven. In this manner, PIM (1) of Example 1 was obtained. PIM (1) is an organic polymer represented by the following structural formula. PIM (1) is an organic polymer having a Tröger's base skeleton.

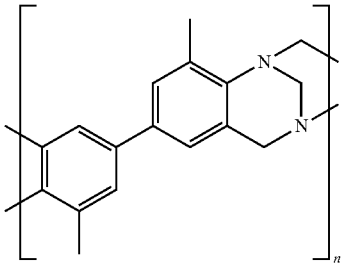

Preparation of Sample for Evaluation of Catalytic Activity

PIM (1) was mixed with the mixture of the Ni—Fe LDH and the Ni particles such that the mass ratio between the mixture of the Ni—Fe LDH and the Ni particles and PIM (1) became 20:1, and the total mass became 21 mg. 1.05 mL of chloroform (special grade reagent, manufactured by FUJIFILM Wako Pure Chemical Corporation) was added to the resulting mixture. Accordingly, a catalyst ink solution was prepared. The catalyst ink solution was sonicated with an ultrasonic homogenizer for 30 minutes. In this manner, a catalyst ink of Example 1 was prepared. 10 μL of the catalyst ink of Example 1 was added dropwise onto a rotating disk electrode, and the resultant was dried at room temperature. In this manner, a sample for evaluation of catalytic activity of Example 1 was obtained.

Example 2

A sample for evaluation of catalytic activity of Example 2 was obtained as in Example 1, except that PIM (2) was used as an organic binder instead of PIM (1). PIM (2) is an organic polymer represented by the following structural formula. PIM (2) is an organic polymer having a Tröger's base skeleton.

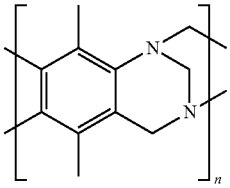

Example 3

A sample for evaluation of catalytic activity of Example 3 was obtained as in Example 1, except that PIM (3) was used as an organic binder instead of PIM (1). PIM (3) is an organic polymer represented by the following structural formula. PIM (3) is an organic polymer having a Tröger's base skeleton.

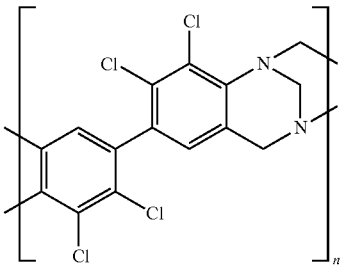

Example 4

A sample for evaluation of catalytic activity of Example 4 was obtained as in Example 1, except that PIM (4) was used as an organic binder instead of PIM (1), PIM (4) is an organic polymer represented by the following structural formula. PIM (4) is an organic polymer having a Tröger's base skeleton.

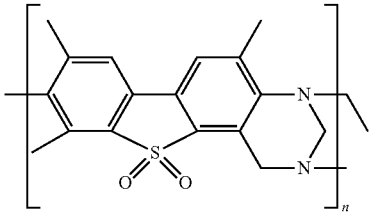

Example 5

Preparation of Ni—Fe LDH Supported on Ketjen Black Support

A Ni—Fe LDH was prepared as follows. First, a mixed solvent of water and ethanol (special grade reagent, manufactured by FUJIFILM Wako Pure Chemical Corporation) was prepared. A volume ratio between the water and the ethanol was 2:3. Nickel chloride hexahydrate (manufactured by FUJIFILM Wako Pure Chemical Corporation) and iron chloride hexahydrate (manufactured by FUJIFILM Wako Pure Chemical Corporation) were dissolved in the mixed solvent such that a total concentration of the Ni ions and Fe ions became 1.0 M, and the ratio of the amount of substance of the Fe ions to the total amount of substance of the Ni ions and the Fe ions became 0.33. Note that "M" denotes "mol/dm$^3$". Furthermore, acetylacetone (ACAC), which was used as a chelating agent, was added such that the amount of substance of the acetylacetone became one-third of the total amount of substance of the Ni ions and the Fe ions. The obtained solution was stirred for 30 minutes. Subsequently, propylene oxide (POX), which was used as a pH raising agent, was added such that the amount of substance of the POX became twice the amount of substance of the chloride ions present in the solution. The resultant was stirred for 1 minute. In such an instance, POX gradually scavenges hydrogen ions in the solution, and, therefore, the pH of the solution gradually increases.

Accordingly, the obtained solution was allowed to stand for approximately three days, and subsequently, the LDH, which was the target sample, was collected. Note that the above-described method for preparing the is merely an example, that is, the method is a non-limiting example. A particle size distribution of the Ni—Fe LDH dispersed in the solution was obtained by small angle X-ray scattering (SAXS), by using a SmartLab, manufactured by Rigaku Corporation. A relationship between the obtained particle diameters and distribution was represented in a two-dimensional distribution graph. The area in the two-dimensional distribution graph was divided by the total number of the particles to determine the average particle diameter of the LDH. The average particle diameter of the Ni—Fe LDH was 10 nm.

Ketjen Black EC600JD, manufactured by Lion Specialty Chemicals Co., Ltd., was mixed with the obtained Ni—Fe LDH such that the mass ratio between the Ni—Fe LDH and the Ketjen black became 2:1, and the total mass became 8.5 mg. Accordingly, a Ni—Fe LDH supported on a Ketjen black support was prepared. A sample for evaluation of catalytic activity of Example 5 was obtained as in Example 1, except that, in Example 5, the Ni—Fe LDH supported on a Ketjen black support was used.

Example 6

A sample for evaluation of catalytic activity of Example 6 was obtained as in Example 1, except that $IrO_x$ SA100, manufactured by Tanaka Kikinzoku Kogyo K. K., was used instead of the mixture of the Ni—Fe LDH and the Ni particles, and that the mixing was performed such that the mass ratio between the $IrO_x$ and PIM (1) became 5:1, and the total mass became 6 mg.

Comparative Example 1

A sample for evaluation of catalytic activity of Comparative Example 1 was obtained as in Example 1, except that a Sustainion, manufactured by Dioxide Materials, was used as an organic binder instead of PIM (1).

Comparative Example 2

A sample for evaluation of catalytic activity of Comparative Example 2 was obtained as in Example 1, except that FAA-3, manufactured by Fumatech, was used as an organic binder instead of PIM (1), and 1.03 mL of chloroform was used.

Evaluation of Overvoltage of Catalyst

The overvoltage of the sample for evaluation of catalytic activity of each of the Examples and the Comparative Examples was measured. The measurement was carried out by using a potentiostat VersaSTAT 4, manufactured by Princeton Applied Research, and a rotating electrode AFE3T050GC, manufactured by Pine Research. The current produced by the anode reaction in the water electrolysis cell was measured by using a rotating disk electrode (RDE) method under the following measurement conditions. The anode reaction is an oxygen evolution reaction. The results are shown in Table 1.

Measurement Conditions

Solution: a 1 M KOH solution

Potential: 1.0 V to 1.65 V (vs. reversible hydrogen electrode (RHE))

Potential sweep rate: 10 mV/sec

Electrode rotation speed: 1500 revolutions per minute (rpm)

TABLE 1

| | Catalyst ink | | | Overvoltage |
|---|---|---|---|---|
| | Catalyst | Support | Organic binder | (mV) |
| Example 1 | Ni—Fe LDH | Ni | PIM (1) | 267 |
| Example 2 | Ni—Fe LDH | Ni | PIM (2) | 273 |
| Example 3 | Ni—Fe LDH | Ni | PIM (3) | 270 |
| Example 4 | Ni—Fe LDH | Ni | PIM (4) | 287 |
| Example 5 | Ni—Fe LDH | KB | PIM (1) | 256 |
| Example 6 | $IrO_x$ | — | PIM (1) | 265 |
| Comparative Example 1 | Ni—Fe LDH | Ni | Sustainion | 392 |
| Comparative Example 2 | Ni—Fe LDH | Ni | FAA-3 | 337 |

Table 1 shows the results of the measurement of the overvoltage, which was performed on the samples for evaluation of catalytic activity of Examples 1 to 6 and Comparative Examples 1 and 2. The overvoltage shown in Table 1 is one that occurred in the first cycle of the redox reaction.

The catalyst inks of Examples 1 to 6 had a low overvoltage in the redox cycle. As a result, with each of the catalyst inks of Examples 1 to 6, an increase in the overvoltage was inhibited. The polymers of intrinsic microporosity used as an organic binder in Examples 1 to 6 had porosity, and, therefore, the catalysts could be exposed from the polymers of intrinsic microporosity. Presumably, as a result of this, an increase in the overvoltage was inhibited with each of the catalyst inks of Examples 1 to 6. In addition, the catalyst ink of Example 6 had a low overvoltage in the redox cycle. This demonstrated that the catalyst ink had a low overvoltage even in the instance in which $IrO_x$, which is a catalyst material having a conductivity, was used.

On the other hand, the catalyst inks of Comparative Examples 1 and 2 had a high overvoltage. In the catalyst inks of Comparative Examples 1 and 2, no organic binder having porosity was used. Presumably, as a result of this, the catalyst material was covered by the organic binder, which reduced the catalytic activity.

According to the present disclosure, the electrode catalyst for a water electrolysis cell can be used in water electrolysis devices.

What is claimed is:

1. An electrode catalyst for a water electrolysis cell, the electrode catalyst comprising:

a catalyst including a layered double hydroxide or a metal oxide; and a polymer of intrinsic microporosity, the polymer of intrinsic microporosity being neutral.

2. The electrode catalyst for a water electrolysis cell according to claim 1, wherein the polymer of intrinsic microporosity has a Tröger's base skeleton.

3. The electrode catalyst for a water electrolysis cell according to claim 1, wherein the polymer of intrinsic microporosity has a spirobiindane skeleton.

4. The electrode catalyst for a water electrolysis cell according to claim 1, wherein the polymer of intrinsic microporosity has a polyimide skeleton.

5. A water electrolysis cell comprising:

an anode;

a cathode; and an electrolyte membrane disposed between the anode and the cathode, wherein at least one selected from the group consisting of the anode and the cathode includes the electrode catalyst according to claim 1.

6. The water electrolysis cell according to claim 5, wherein the electrolyte membrane includes a proton exchange membrane.

7. The water electrolysis cell according to claim 5, wherein the electrolyte membrane includes an anion exchange membrane.

8. A water electrolysis cell comprising:

a diaphragm that separates a first space from a second space;

an anode provided in the first space; and a cathode provided in the second space, wherein at least one selected from the group consisting of the anode and the cathode includes the electrode catalyst according to claim 1.

9. A water electrolysis device comprising:

the water electrolysis cell according to claim 5; and a voltage applicator that applies a voltage between the anode and the cathode, the voltage applicator being connected to the anode and the cathode.

10. A water electrolysis device comprising:

the water electrolysis cell according to claim 8; and a voltage applicator that applies a voltage between the anode and the cathode, the voltage applicator being connected to the anode and the cathode.

* * * * *